US006049986A

United States Patent [19]

Calkins et al.

[11] Patent Number: 6,049,986

[45] Date of Patent: Apr. 18, 2000

[54] CHAIN SAW GUIDE BAR EQUIPPED WITH CHAIN TENSIONER

[75] Inventors: Eugene E. Calkins, Keizer; Kent L. Huntington, Molalla; Mark D. Lamey, Gresham, all of Oreg.

[73] Assignee: Blount, Inc., Portland, Oreg.

[21] Appl. No.: 08/944,933

[22] Filed: Oct. 2, 1997

[51] Int. Cl.[7] ..... B27B 17/14

[52] U.S. Cl. ..... 30/386; 30/383

[58] Field of Search ..... 30/381, 383, 385, 30/386; 83/814, 816

[56] References Cited

U.S. PATENT DOCUMENTS

| | | | |
|---|---|---|---|
| 2,289,123 | 7/1942 | Jones . | |
| 2,532,981 | 12/1950 | Wolfe . | |
| 2,765,821 | 10/1956 | Strunk . | |
| 2,774,395 | 12/1956 | Tweedie . | |
| 3,267,973 | 8/1966 | Beard | 30/386 |
| 3,327,741 | 6/1967 | Merz | 30/386 |
| 3,382,898 | 5/1968 | Walker . | |
| 3,457,970 | 7/1969 | Locati . | |
| 3,636,995 | 1/1972 | Newman . | |
| 3,647,270 | 3/1972 | Althaus . | |
| 3,866,320 | 2/1975 | Progi | 30/386 |
| 3,901,563 | 8/1975 | Day . | |
| 4,129,943 | 12/1978 | Bricker | 30/386 |
| 4,269,099 | 5/1981 | Saito | 83/819 |
| 4,316,327 | 2/1982 | Scott | 30/386 |
| 4,361,960 | 12/1982 | Halvorson | 30/385 |
| 4,382,334 | 5/1983 | Reynolds | 30/386 |
| 4,486,953 | 12/1984 | Halverson | 30/385 |
| 4,563,817 | 1/1986 | Leighton | 30/386 |
| 4,567,658 | 2/1986 | Wissmann | 30/386 |
| 4,819,335 | 4/1989 | Alexander | 30/386 |
| 4,835,868 | 6/1989 | Nagashima | 30/386 |
| 4,920,650 | 5/1990 | Edlund | 30/386 |
| 4,999,918 | 3/1991 | Schliemann | 30/386 |
| 5,070,618 | 12/1991 | Edlund | 30/386 |
| 5,174,029 | 12/1992 | Talberg | 30/386 |
| 5,497,577 | 3/1996 | Martinsson | 30/386 |
| 5,528,835 | 6/1996 | Ra | 30/386 |

FOREIGN PATENT DOCUMENTS

| | | | |
|---|---|---|---|
| 1329966 A1 | 9/1985 | U.S.S.R. . | |
| 1329966 | 8/1987 | U.S.S.R. | 30/386 |
| 1894 | 1/1909 | United Kingdom | 83/816 |

*Primary Examiner*—Hwei-Siu Payer
*Attorney, Agent, or Firm*—Robert L. Harrington

[57] ABSTRACT

A chain saw guide bar has self-contained mechanism to force movement of the guide bar away from a drive sprocket to tension the saw chain. The mechanism includes a bearing surface that engages a mounting stud on the chain saw housing and a rotatable portion which upon rotation causes axial displacement of the bearing surface in contact with the stud.

16 Claims, 6 Drawing Sheets

CHAIN SAW GUIDE BAR EQUIPPED WITH CHAIN TENSIONER

FIELD OF THE INVENTION

This invention relates to a guide bar on which is provided a mechanism for shifting the position of the bar relative to a chain saw sprocket to thereby tension a saw chain entrained around the bar and sprocket.

BACKGROUND OF THE INVENTION

A chain saw is essentially a power head that drives a drive shaft and provides for the mounting of a guide bar. The drive shaft is provided with a drive sprocket that meshes or mates with a saw chain which is mounted around the sprocket and guide bar. A loop of saw chain is essentially non-elastic and needs to be set to a precise degree of tension when entrained around the sprocket and bar. A chain that is too tight will cause power loss and rapid wearing, whereas a chain that is too loose will enable the chain to jump the track of the guide slot of the guide bar.

To permit mounting of the chain and subsequent adjustment of the chain tension, the bar is designed to be adjustable in a linear direction relative to the sprocket. Typically a pair of spaced apart mounting studs provided on the chain saw housing project through an elongated slot on the bar. The studs permit sliding adjustment of the bar toward and away from the sprocket but substantially only in a linear direction. (Some pivotal movement results from the tolerance between the slot width and diameter of the studs.) The studs are threaded and following adjustment, a clamping nut threaded onto one or both mounting studs secure the bar in place. Adjustment is typically achieved by a mechanism mounted on the chain saw housing. A nut is moved back and forth along the housing by turning a screw. A finger projected from the nut is inserted into a hole in the bar and turning of the screw imparts sliding movement of the bar along the studs.

The above typical arrangement is unsatisfactory for several reasons. The screw and nut adjustment mechanism add cost to the chain saw manufacture. Adjustment requires manipulation of a screw driver between the housing and bar. When mounting the bar and the chain saw, care must be taken to insure that the finger of the adjustment mechanism is inserted into the bar hole. The clamping nut is typically on the side of the bar opposite the adjustment mechanism and a novice user will occasionally try to adjust the bar without loosening the clamping nut. This can cause damage to the mechanism. There is also risk of injury to hands or arms from contact with the chain while reaching over the guide bar. Whereas installation of the chain has been described above, a chain will loosen over a period of operation and the tensioning process has to be repeated on a periodic basis.

It is accordingly an objective of the present invention to provide an adjustment mechanism within the bar itself, which is more readily accessible to the user, inexpensive to produce, improves safety, is easier to mount and is more reliable than the heretofore described typical mounting mechanism.

SUMMARY OF THE INVENTION

A preferred embodiment of the present invention applies to a laminated bar having a center laminate and two side laminates welded together. In one version the center laminate is provided with a configured cavity including a channel portion in which a rack-like member (hereafter referred to as a rack) resides and a circular portion in which a pinion-like member (hereafter referred to as a pinion) resides. The rack and pinion have mated exterior teeth and an opening through at least one of the side rails (opposite the chain saw housing) enables manual turning of the pinion, e.g., a notch in the pinion is accessible to a screw driver blade for turning the pinion and forcing sliding of the rack within the channel.

The rear end of the rack is provided with a bearing edge (preferably in a V or U shape). The rear end of the rack projects into the mounting slot of the bar whereby the bearing edge engages the outer most mounting stud or boss of the chain saw housing. With the bar mounted on the mounting studs in an un-clamped condition, turning the pinion to force the rear bearing edge of the rack against the mounting stud forces sliding of the bar away from the drive sprocket and tensioning of the saw chain entrained around the bar and sprocket. When properly tensioned, a clamping nut secures the bar to the housing.

The pinion being loose in the circular cavity will become jammed into the forward position relative to the cavity and such jamming resists turning of the pinion, i.e., as may occur through vibration, which can loosen the chain. As an aid to prevent reverse turning, small projections are provided by the cavity configuration which are engaged by the pinion teeth to resist reverse turning. Similarly, small projections can be provided which engage teeth of the rack mechanism.

In a second version, a sliding member or slider, slidable in an enlarged slot in the center laminate, is also provided with a V or U shaped bearing edge at one end that abuts the forward most stud. A circular cam member abuts the opposite end of the sliding member and an integral hub provided on a face of the cam member, offset from the center of the cam member, is projected through a mated opening in an outer laminate. The hub has a slot formed therein that enables the hub and thus the cam member to be turned with a screw driver. The mated opening confines the hub to the opening and thereby defines a bearing surface as the hub is turned. The periphery of the cam member has varying distances to the center of the hub which acts as a pivot point and thus as the cam member is turned about this pivot point, the point of engagement between the cam periphery and the sliding member moves linearly back and forth. With the shorter distance of the periphery from the pivot point at the rearward side of the hub, the sliding member can move forward to shorten the distance between the rear end of the bar and the drive shaft (for mounting of the chain). Turning of the cam member forces the sliding member rearwardly within the bar body and tensioning of the chain.

The V-shaped bearing edge of both versions when forced against the mounting stud or boss causes the bar to be extended in a straight line defined by the mounting stud. Heretofore the bar could be slightly moved angularly due to the existing tolerance between the studs and the slot. For proper tensioning, a user was required to raise the bar to its upper most position when tightening and then to clamp the bar to the housing in that raised position. This maneuver is no longer required. All of the mechanism is manipulated from the outer side of the guide bar which enhances safety and convenience. While illustrated herein as applied to laminated bars, it can be seen that a similar arrangement can be used in solid bars.

The invention in its several versions will be more fully understood upon reference to the following detailed description and accompanying drawings.

DESCRIPTION OF THE PREFERRED EMBODIMENT

Figure 1:
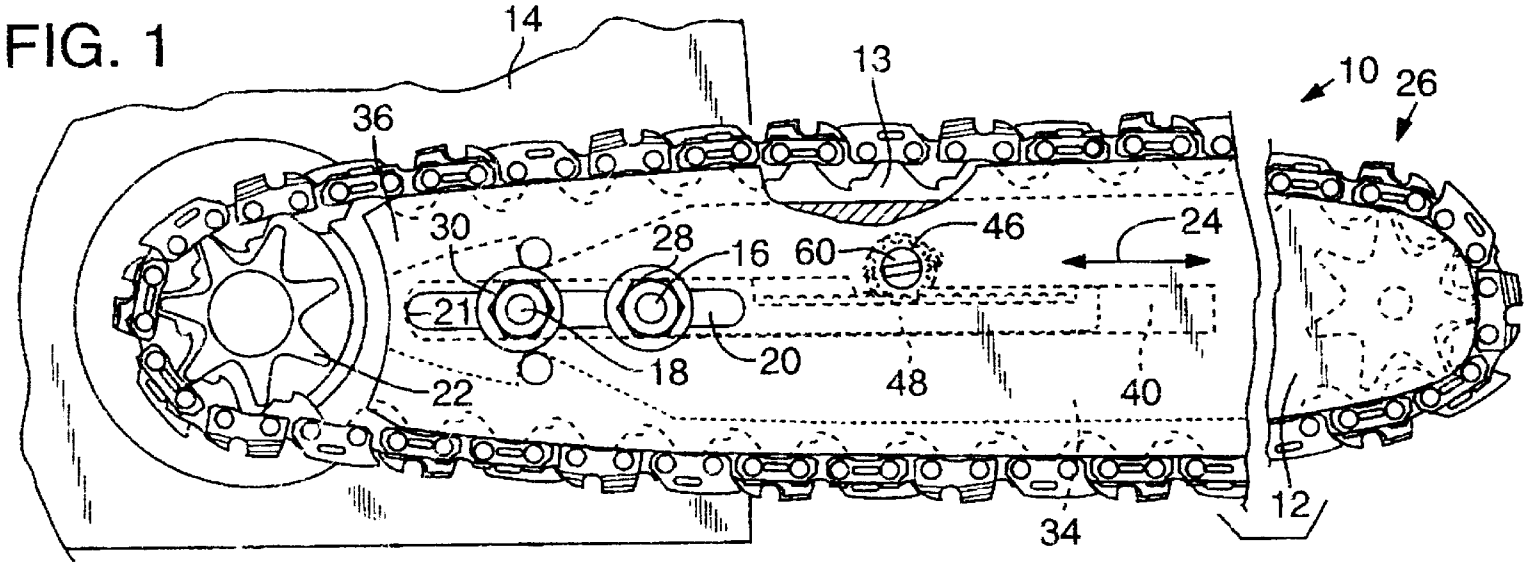
FIG. 1 is a view of a chain saw having a guide bar equipped with a chain tensioner mechanism.

FIG. 1 illustrates a chain saw 10 having a guide bar 12 equipped with a chain tensioner. The bar 12 is mounted to the housing 14 of the chain saw on studs 16 and 18. The bar 12 has a mounting slot 20 that receives the studs 16 and 18 and permits the guide bar 12 to be moved toward and away from a drive sprocket 22 as indicated by arrow 24. The guide bar 12 is moved toward the drive sprocket 22 to permit mounting a saw chain 26 in the edge groove 13 of the guide bar 12 and onto the drive sprocket 22. After the chain 26 has been mounted on the drive sprocket 22 and the guide bar 12, the guide bar 12 is moved away from the drive sprocket 22 to tension the chain 26 to its proper operating condition. When the guide bar 12 has been moved outwardly from the drive sprocket 22 to the desired position, lock nuts 28 and 30 are tightened on the studs 16 and 18 to lock the guide bar 12 in position. (The reader will appreciate that whereas two studs are desirable to control the movement of the bar, locking may be achieved with only one locking nut.)

Figure 3:
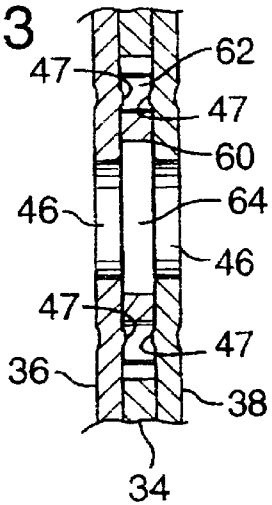
FIG. 3 is a view as if viewed without the cutaway and as taken on view lines 3—3 of FIG. 2.

The guide bar 12 has a tensioner mechanism that will force movement of the guide bar 12 away from the drive sprocket 22 to tighten the saw chain 26. The chain tensioner mechanism is further illustrated in the cut away view of FIG. 2. In this embodiment, the guide bar 12 is of laminated construction having a center laminate 34 sandwiched between outer laminates 36, 38 (see FIGS. 1 and 3). The center laminate 34 and the outer laminates 36, 38 are assembled and fixedly attached to each other in a conventional manner such as by welding. As previously mentioned, the guide bar has a mounting slot 20 that extends through the guide bar 12, that is, through the outer laminates 36, 38 and the center laminate 34 to permit mounting the guide bar 12 onto the studs 16, 18 of the chain saw 10. The slot 20 provided in the outer laminates 36, 38 has a width that corresponds closely to the diameter of the studs 16, 18. The center laminate 34 has a formed slot that provides for the tensioner mechanism as will be explained.

The formed slot of the center laminate 34 has a channel-like portion 40 and a circular portion 42. The circular portion 42 intersects the channel-like portion 40. The channel-like portion 40 has a greater width than the slot 20 in the outer laminates 36, 38. As seen in FIG. 1, the portion 40, shown in dash lines, extends from end 21 to a position well beyond the end of slot 20, the added length (and width) provided to house the tensioning mechanism.

Figure 2:
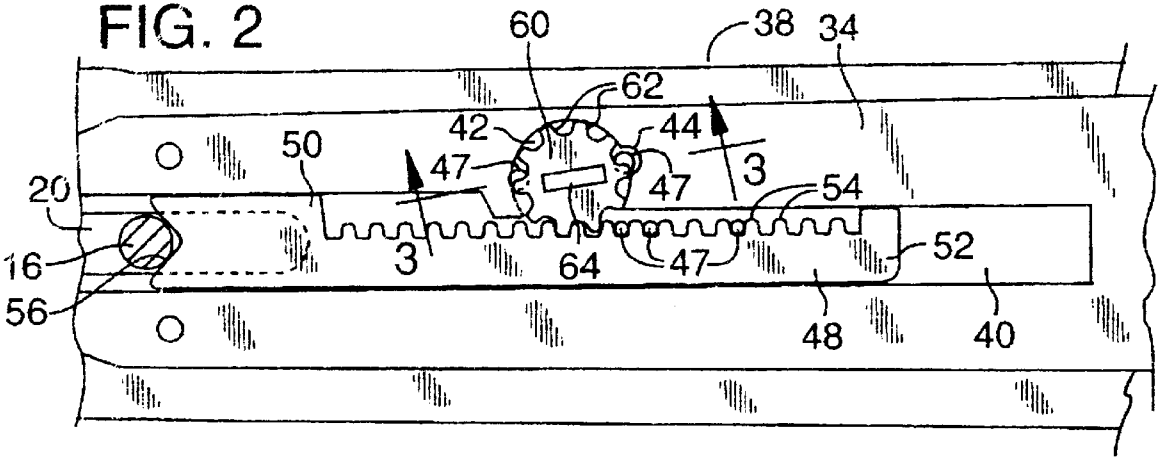
FIG. 2 is a cut away view of the guide bar of the chain saw of FIG. 1 illustrating the chain tensioner mechanism of FIG. 1.
Figure 8:
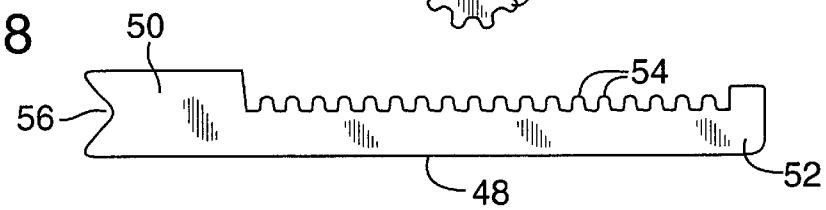
FIG. 8 is a view of a rack of the chain tensioner mechanism.

A rack 48 (see also FIG. 8) is inserted in the channel portion 40 and is movable along the length of the channel 40 as shown in FIG. 2. An end portion 50 of the rack 48 has a width that corresponds closely to the width of the channel 40 and thus wider than the width of slot 20. The opposite end portion 52 is similarly of a width corresponding closely to the width of the channel 40. Gear-like teeth 54 are formed along the length of the rack 48 between the end portions 50 and 52. The end portion 50 of the rack 48 has a V-groove formation 56 formed on its end. The groove 56 will engage the stud 16 of the chain saw 10 when the guide bar 12 is mounted to the housing 14.

The embodiments described and illustrated utilize the stud 16 which projects from the housing 14 and is typically threaded and is intended for aligning and affixing the guide bar relative to the housing. The present invention utilizes this threaded stud as a convenient bearing member. It will be appreciated, however, that other projections provided on the housing 14 such as a formed box for bar alignment only or even a projection specifically provided as a bearing member is encompassed by this invention. Reference to a bearing member is intended to include all such projections.

Figure 7:
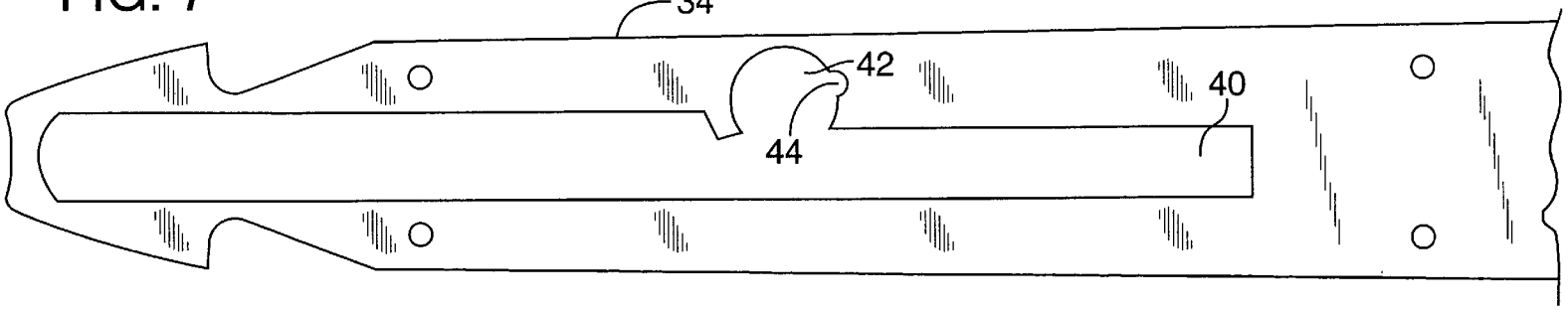
FIG. 7 is a view of a center laminate of the guide bar of the chain saw of FIG. 1.
Figure 9:
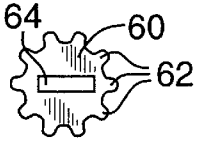
FIG. 9 is a view of a pinion of the chain tensioner mechanism.

The circular portion 42 of the cavity (see also FIG. 7) receives a pinion 60 (FIG. 2). The diameter of the pinion 60 is slightly smaller than the diameter of the circular portion 42. The pinion 60 has teeth 62 formed on its periphery and are of a size to mesh with the teeth 54 of the rack 48. As previously mentioned, the circular portion 42 intersects the channel 40 and thus the pinion 60 is engageable with the rack 48. The pinion 60 does not have a fixed axis of rotation but is allowed to float in the circular portion 42. The pinion 60 has a centrally positioned slot 64 that extends clear through and is provided for utilization of a tool, e.g., a screw driver, to rotate the pinion 60.

The circular portion 42 has a diameter that is just larger than the pinion 60 which allows the pinion 60 to float within the circular portion 42. The circular portion 42 has a small arcuate cut out 44 that is arranged to engage one of the teeth 62 when the pinion 60 floats toward the cut out 44. The function of the cut out 44 and the relation of the teeth 62 will be later explained.

An aperture 46 is provided in at least one of the outer laminates 36, 38 with the aperture 46 being positioned in alignment with the circular portion 42 provided in the center laminate 34. The aperture 46 is provided (and positioned) so as to permit inserting a tool into the slot 64 of the pinion 60.

As shown in FIG. 2, the teeth 62 of the pinion 60 are in meshed engagement with the teeth 54 of the rack 48. Rotation of the pinion 60 thus will force movement of the rack 48 along the channel 40.

Referring to FIG. 1, the guide bar 12 is initially mounted on the studs, 16, 18 of the chain saw 10 with the studs 16, 18 being received in the slot 20 of the guide bar 12. Nuts 28, 30 are loosely installed on the studs 16, 18 (or alternatively on only one of the studs) permitting the guide bar 12 to be slidably movable along the studs 16, 18 as indicated by arrow 24. The guide bar 12 is initially moved toward the drive sprocket 22 to permit mounting the saw chain 26 onto the drive sprocket 22 and the guide bar 12 in the conventional manner. This will require that the rack 48 be moved away from the end 21 of the slot 20 by rotating the pinion 60. When the saw chain 26 is properly entrained around the drive sprocket and the guide bar 12, the guide bar 12 is moved outwardly away from the drive sprocket 22 by utilizing the chain tensioner. A tool suitable for rotating the pinion 60 such as the tip of a flat bladed screwdriver is inserted through the aperture 46 and into the slot 64 of the pinion 60. The pinion 60 is rotated such that the rack 48 will be forced against the stud 16. The V-groove 56 of the rack 48 coming in contact with the stud 16 will tend to center the guide bar 12 relative to the studs 16, 18. Further rotation of the pinion 60 will force the guide bar 12 to move away from the drive sprocket 22. When the guide bar has been moved a sufficient distance away from the drive sprocket 22 to provide the proper operating tension of the saw chain 26, nuts 28 and 30 are tightened onto the studs 16, 18 to clamp the guide bar 12 to the housing 14.

Figure 4:
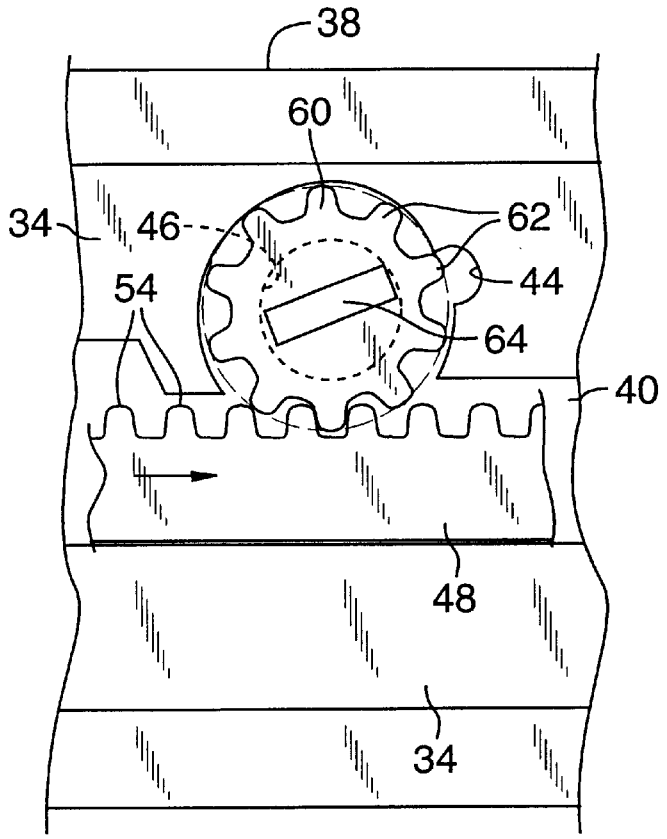
FIGS. 4 and 5 are views illustrating the relation between a pinion and rack of the chain tensioner mechanism.
Figure 5:
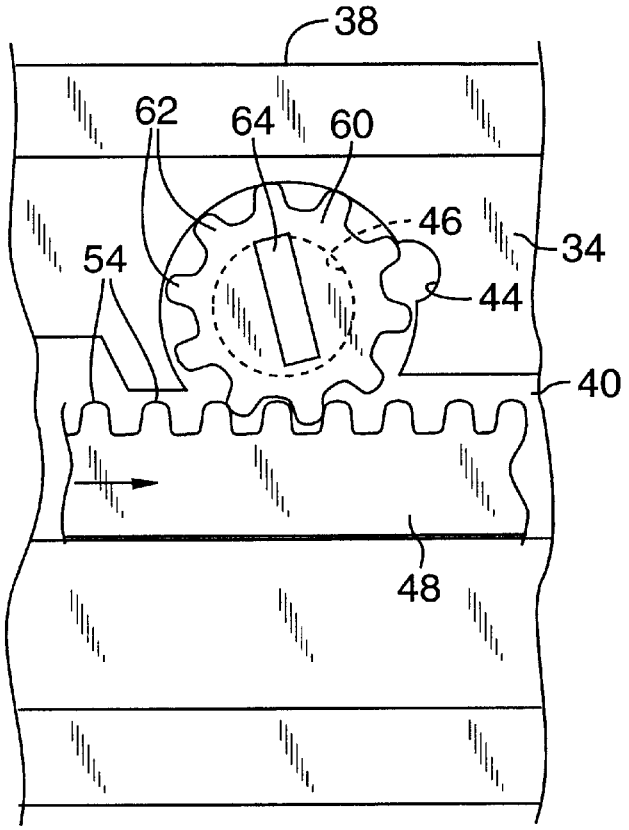
Figure 6:
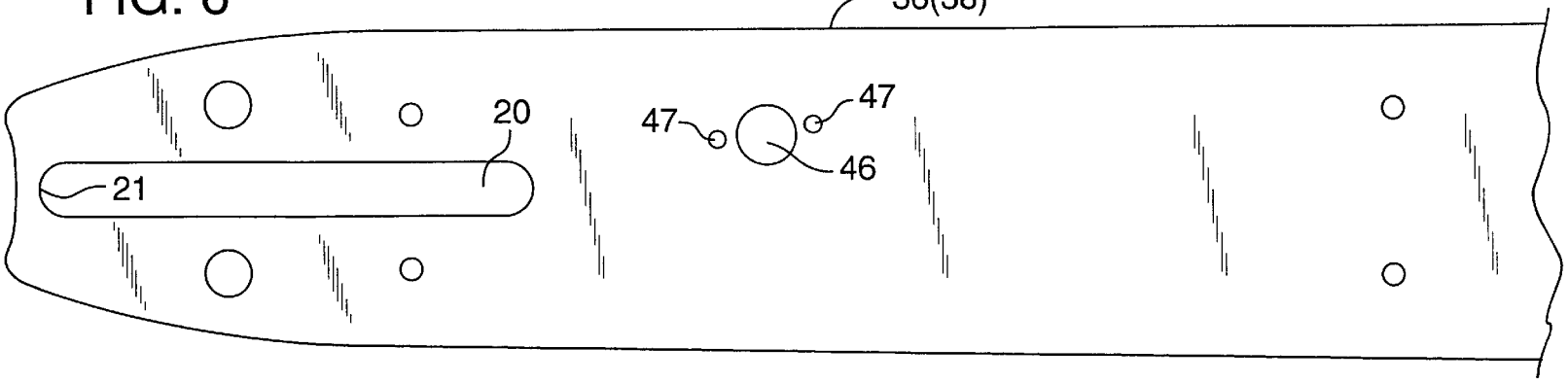
FIG. 6 is a view of an outer laminate of the guide bar of the chain saw of FIG. 1.

The pinion 60, as it is rotated to force the rack 48 against the stud 16, tends to elevate or climb off the teeth 54 of the rack 48. This forces the pinion 60 away from the rack 48 and moves one of the teeth 62 into engagement with the cut out 44 as shown in FIG. 4. The tooth 62 in contact with the cut out 44 will resist reverse rotation of the pinion 60 and thus will maintain the rack 48 in positive engagement with the stud 16. Forced rotation of the pinion 60 in the reverse direction will however disengage the tooth 62 from the cut out 44 and permit reversal of the rack 48 for removal of the chain as shown in FIG. 5.

The outer laminates 36, 38 may be dimpled (best seen in FIG. 3) to provide a formed upset (small projection) 47 on the interior surface of the outer laminates 36, 38 strategic to the travel path of the teeth 62 of the pinion 60. The formed upsets 47 are positioned such that the teeth 62 must travel over the upsets 47 and thus they also will aid in resisting rotation of the pinion 60. The formed upsets may be used instead of the cut out 44 and alternatively the formed upsets 47 may be placed in the path of the rack teeth 54 as illustrated in FIG. 2.

Figure 10:
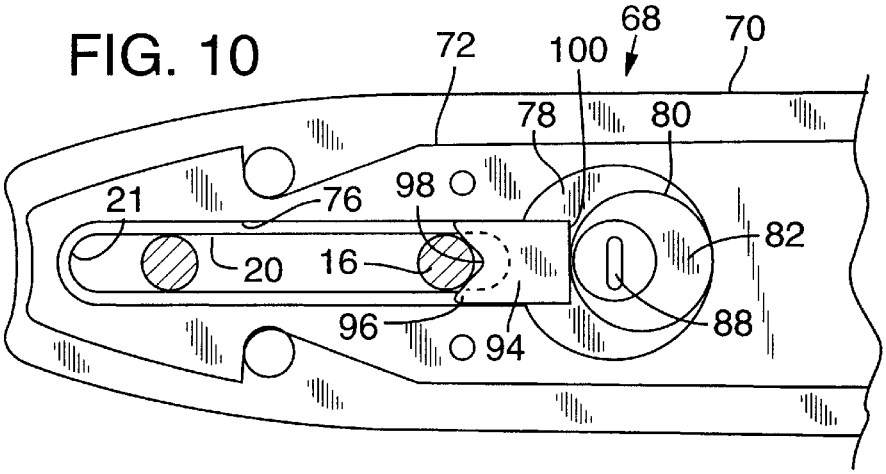
FIG. 10 is a view of another embodiment of the chain tensioner mechanism.
Figure 11:
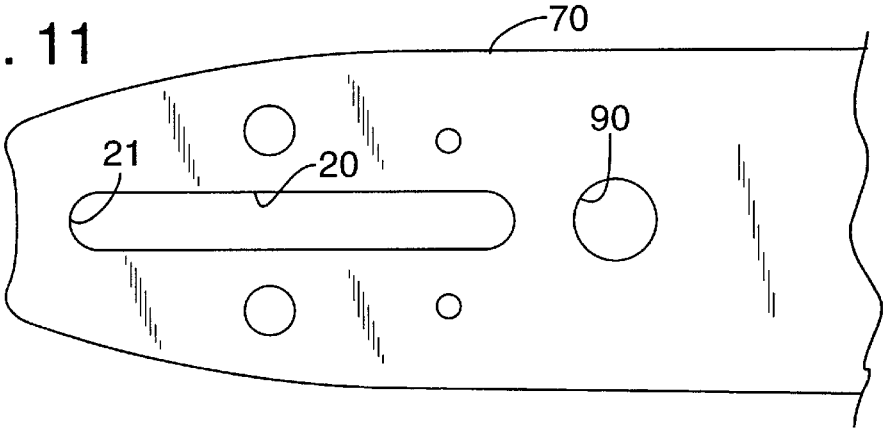
FIG. 11 is a view of an outer laminate of the guide bar of FIG. 10.

Refer now to FIG. 10 of the drawings which illustrates another embodiment of a chain tensioner incorporated into a guide bar 68. FIG. 10 is a cutaway view of the guide bar 68 that shows one outer laminate 70 and the inner laminate 72. The other outer laminate is not shown in the drawings, however, the guide bar 68 when assembled has the inner laminate 72 fixedly mounted between the outer laminates. The outer laminate 70 has a mounting slot 20 (FIG. 11) as provided in the guide bar 12 of FIG. 1. The center laminate 72 has a formed elongate slot 76 that extends from an end 21 of the slot 20 in the outer laminate 70. The elongate slot 76 intersects a circular slot 78 formed in the center laminate 72. A cam member 80 is rotatably mounted in the circular slot 78.

Figure 12:
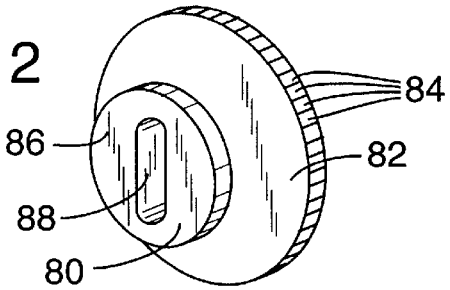
FIG. 12 is a view of the cam member of FIG. 10.

The cam member 80 is further illustrated in FIG. 12. The cam member 80 has an eccentric portion 82 that is offset from a hub portion 86. The eccentric portion 82 preferably has flats 84 formed on its periphery with the flats 84 being normal to a radius extended from the center of the hub 86. A slot 88 is provided in the hub 86 and the slot 86 is provided for the insertion of a tool such as a flat bladed screwdriver to rotate the cam member 80. The hub 86 preferably (but not necessarily) extends on both sides of the eccentric portion 82 of the cam member 80. The hub 86 is seated in an aperture 90 (see FIG. 11) preferably provided in each of the outer laminates 70. Apertures 90 are sized to fit hub 86 and permit rotational and not linear movement of the hub.

Figure 13:
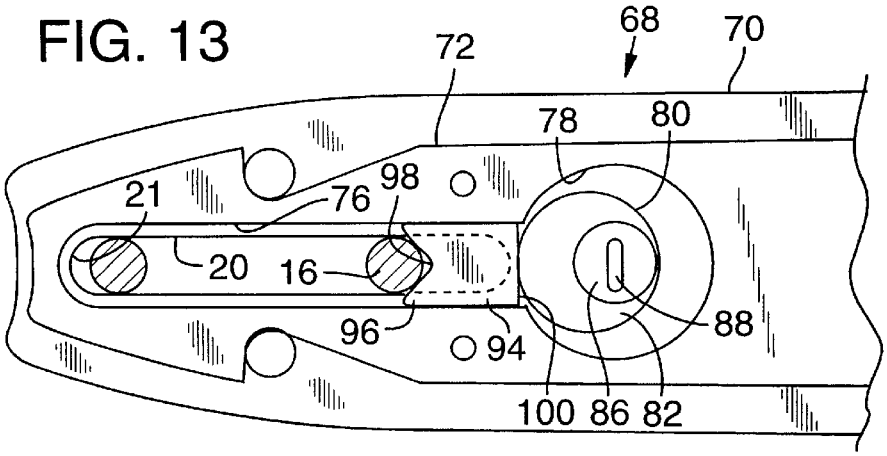
FIG. 13 is a view similar to FIG. 10 illustrating the cam mechanism in an alternate position.

A slider member 94 is sized to fit in the slot 76 in the center laminate 72. The slider member 94 is slidably adjustable along the length of the slot 76 in the center laminate 72. An end 96 of the slider 94 has a V-groove formation 98. The V-groove formation 98 is arranged to engage the stud 16 of the chain saw 10 when the guide bar is mounted to the housing 14. The opposite end 100 of the slider 94 engages the flats 84 of the eccentric portion 82 of the cam member 80. As seen in FIG. 10, the eccentric portion 82 is rotated to permit the slider 94 to be moved inwardly into the circular slot 78 and thus the guide bar may be moved toward the drive sprocket 22 of the chain saw 10 for the mounting of the saw chain on the sprocket 22 and guide bar 68. When the guide bar 68 is loosely fitted to the chain saw 10 as previously described, the cam member 80 is rotated to force the slider 94 against the stud 16 to thus force the guide bar to move away from the drive sprocket 22 (as illustrated in FIG. 13). As the cam member 80 is rotated, one of the flats 84 will be in contact with the end 100 of the slider 94. There is thus a flat-to-flat contact between the cam member 80 and the slider 94 and this tends to restrain rotation of the cam member 80 in the circular slot 78. When the cam member 80 has been rotated to adjust the guide bar to the desired position such as shown in FIG. 13, for example, the lock nuts 28, 30 are tightened to clamp the guide bar into position.

Each of the outer laminates 70, 74 preferably have an aperture 90 and the extending hubs 86 are fitted therein. This permits the reversible mounting of the guide bar on the chain saw 10 with outer-side access to the cam member 80 regardless of which side is exposed.

Figure 14:
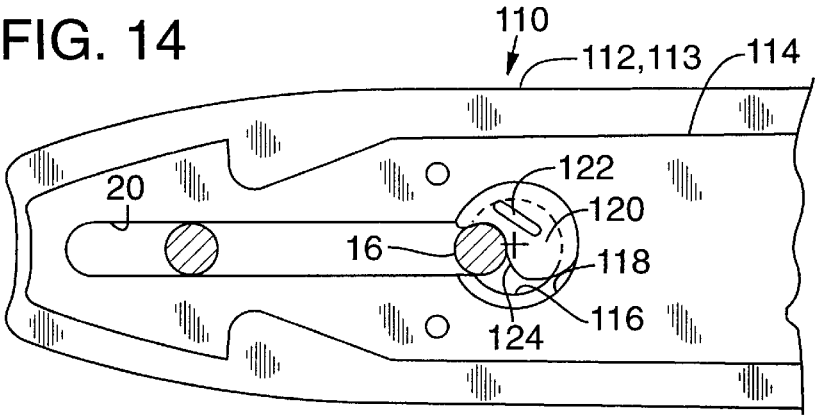
FIG. 14 is a view of another embodiment of the chain tensioner mechanism.
Figure 15:
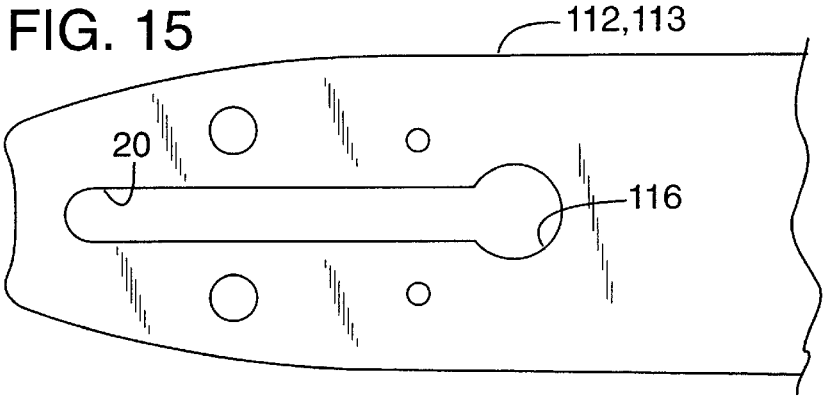
FIG. 15 is a view of an outer laminate of the guide bar of FIG. 14.
Figure 16:
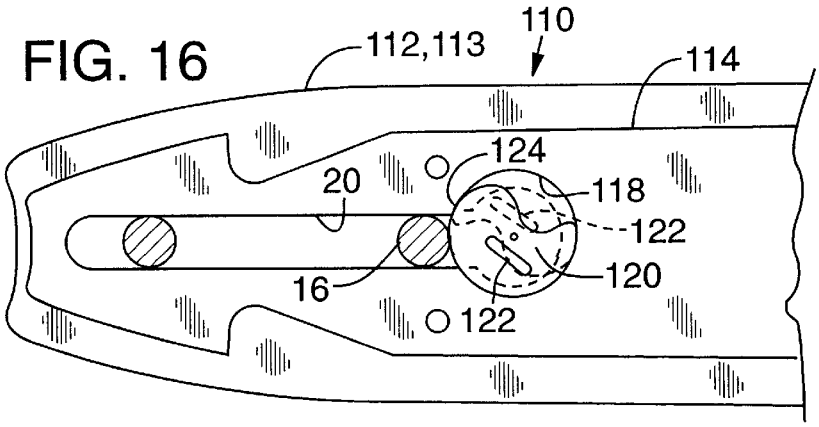
FIG. 16 is a view similar to FIG. 14 showing a different operative position of tensioner.

FIG. 14 illustrates a guide bar 110 that incorporates a further embodiment of a chain tensioning mechanism. FIG. 14 is a cutaway view that shows an outer laminate 112 and an inner laminate 114. The other outer laminate 113 is shown in FIGS. 14–16. The outer laminate 112 (113) is further illustrated in FIG. 15. The outer laminate 112 (113) has a mounting slot 20 that extends to and intersects with a circular slot 116. The inner laminate 114 also has a mounting slot 20 that extends and intersects with a circular slot 118. The circular slot 116 of the outer laminate 112 (and 113) has a smaller diameter than the circular slot 118 of the center laminate 114.

An arcuate cam member 120 is mounted in the circular slot 118 of the inner laminate 114 with the arcuate cam member 120 being rotatable in the circular slot 118. The cam member 120 is retained in the center laminate 114 when the bar is assembled by the smaller diameter of the circular slot 116 in the outer laminates 112, 113. A slot 122 is provided in the cam member 120 with the slot 122 being of a size that would allow the insertion of a tool to rotate the cam member 120 within the bar 110. The cam member 120 has a shaped profile 124 that will engage a mounting stud 16 of the chain saw 10. FIG. 14 illustrates the cam member 120 rotated to a position such that the guide bar 110 may be moved toward the drive sprocket 22 of the chain saw 10. Rotation of the cam member 120 will force the shaped profile 124 of the cam member 120 against the stud 16 which will force the guide bar 110 to be moved away from the drive sprocket 22 resulting in positioning of the cam member 120 as illustrated in FIG. 16.

Figure 17:
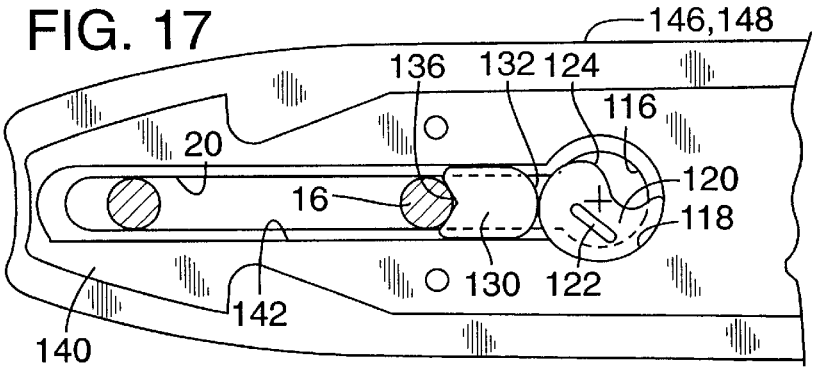
FIG. 17 is a view similar to FIG. 14 incorporating a slider.

FIG. 17 illustrates a tensioning mechanism similar to FIG. 14 incorporated in a guide bar. In FIG. 17 a slider 130 is positioned such that an end 132 will be in contact with the cam surface 124 of the cam member 120. The opposite end of the slider 130 has a V groove 136 that will engage the stud 16 of the chain saw 10. The center laminate 140 has a mounting slot 142 that is greater in width than the mounting slot 20 in the outer laminate 146 (148). The mounting slots 20 of the outer laminates 146, 148 extend to and intersect with a circular slot 116. The slider 130 is sized to fit the mounting slot 142 in the center laminate and thus will be retained by the smaller width mounting slot 20 in the outer laminates 146, 148. The mounting slot 142 of the center laminate 140 extends and intersects the circular slot 118 provided in the center laminate 140. The cam member 120 is mounted in the circular slot 118 as previously described.

Rotation of the cam member 120 as shown in FIG. 17 will force the slider 130 against the stud 16 of the chain saw to cause the guide bar to move away from the drive sprocket 22. When the guide bar has been moved to sufficiently tension the saw chain, the nuts 28, 30 are tightened to clamp the bar in position.

Figure 18:
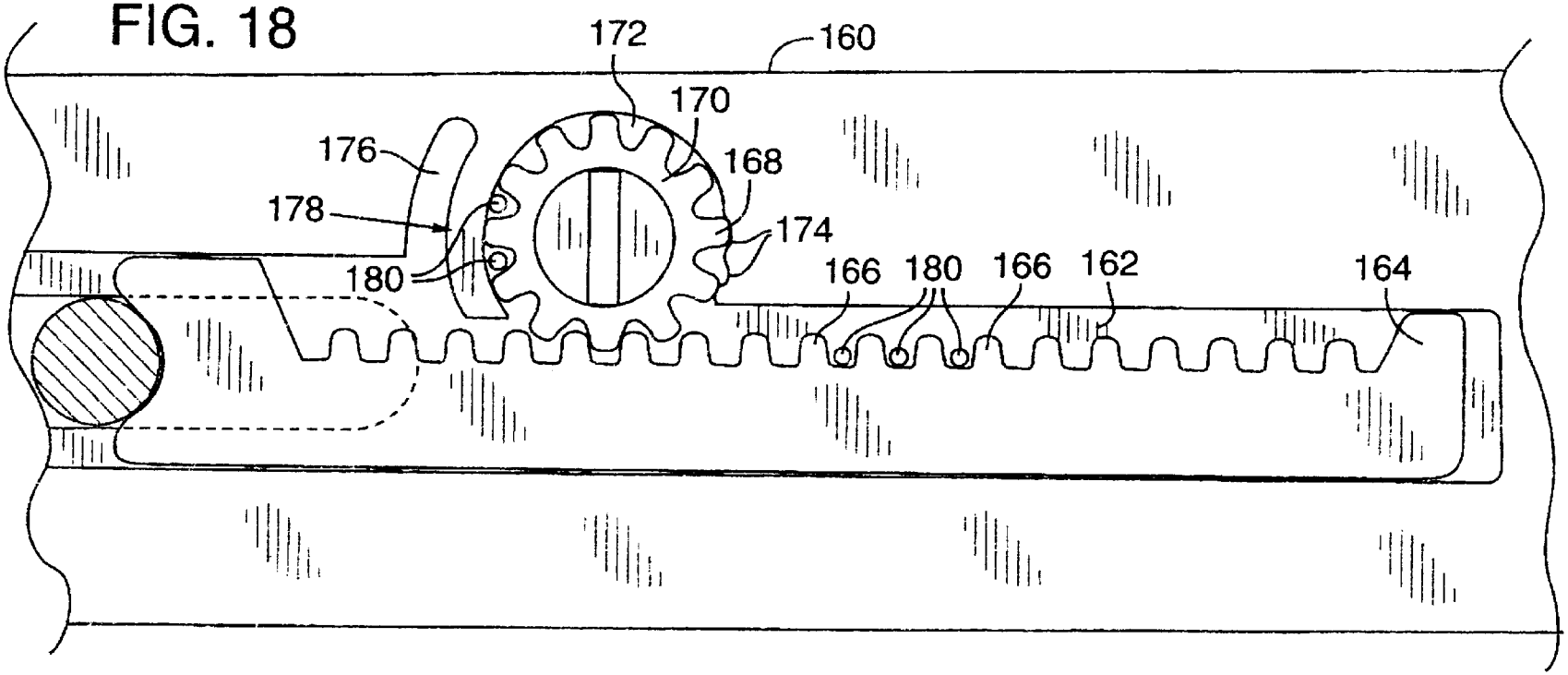
FIG. 18 is a view of another embodiment of the chain tensioner mechanism.

FIG. 18 illustrates another embodiment of a chain tensioner that incorporates a pinion and a rack member and a center laminate 160. The center laminate 160 has an elongate slot 162 for receiving a rack 164. The rack 164 is slidably movable in the slot 162 and has upstanding teeth 166 that will engage or mesh with teeth 168 of a pinion 170. The laminate 160 has an arcuate or circular slot 172 that receives the pinion 170. The circular slot 172 has arcuate detents 174 which will be engaged by the teeth 168 of the pinion 170 to resist rotation of the pinion 170. The center laminate 160 has an arcuate slot 176 that extends from the elongate slot 162. A resilient arcuate portion or leg 178 is formed as a result of the arcuate slot 176 and the circular slot 172. The circular slot 172 is sized such that the teeth 168 of the pinion 170 will be forced into the arcuate detents 174. The leg 178 acts as a spring to force the teeth 168 of the pinion 170 into the detents 174. As the pinion 170 is forcibly rotated by a tool as previously described, the leg 178 being resilient will deflect to permit rotation of the pinion 170 and thus cause movement of the rack 164. To further resist rotation of the pinion 170 and thus movement of the rack 164, upsets 180 are provided in the travel path of the teeth 168 of the pinion 170 and further are provided in the travel path of the teeth 166 of the rack 164.

Figure 19:
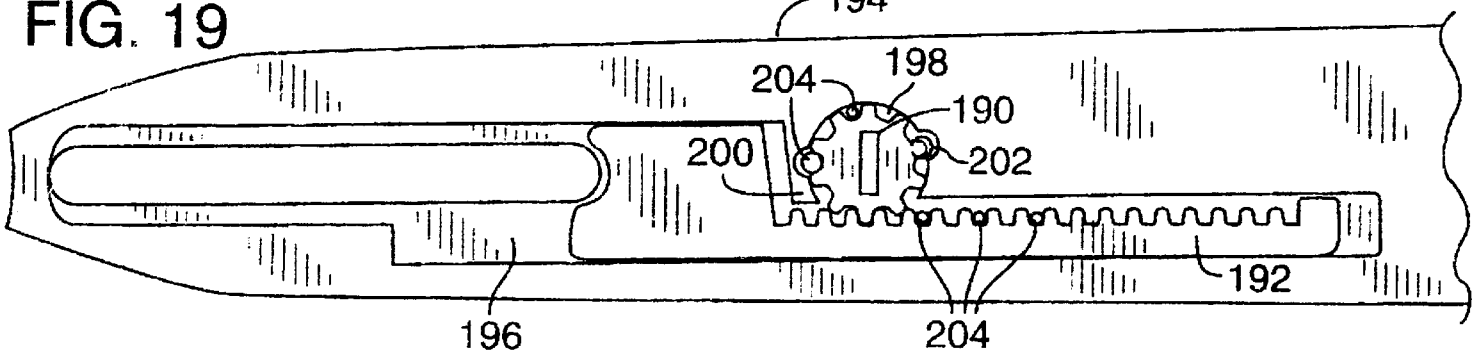
FIG. 19 is a view of another embodiment of the chain tensioner mechanism.

FIG. 19 illustrates another embodiment of the chain tensioner utilizing a pinion 190 and a rack 192 in the center laminate 194. A stepped slot 196 is provided in the center laminate 194 to receive the rack 192. The rack 192 is thus slidably movable in the slot 196. The pinion 190 is received in a circular slot 198 with the pinion 190 arranged to engage the rack 192 in a manner as described with the previous racks and pinions. This arrangement places the pinion 190 near the center of the laminate 194 between the upper and lower edges of the bar. The circular slot 198 and the elongate slot 196 in combination form a depending leg 200 that acts as a resilient spring to force the pinion 190 to engage the detents 202 to provide a resistance to rotation of the pinion 190. Formal upsets 204 are provided in the travel path of the teeth of the pinion 190 and the teeth of the rack 192 to provide a resistance to restrict movement of the pinion and rack.

Those skilled in the art will recognize that modifications and variations may be made without departing from the true spirit and scope of the invention. The invention is therefore not to be limited to the embodiments described and illustrated but is to be determined from the appended claims.

We claim:

1. A chain saw guide bar adapted for mounting to a chain saw having a chain saw housing including a projection positioned forward of a drive sprocket, said guide bar comprising:

an elongated bar defining a bar length and having opposed side faces, a rear end, a forward end and peripheral guide edges for guiding a loop of saw chain from the rear end to and around the forward end and back to the rear end;

a mounting slot at the rear end of the bar adapted to receive the projection of the chain saw housing and to permit sliding movement of the bar relative to the projection and directed along the length of the bar toward and away from the drive sprocket; and a configured cavity between the side faces and encompassing the mounting slot, said configured cavity including a formed portion, and a tensioning mechanism including a rotatable driver portion trapped between the side faces within the formed portion, said driver portion exposed in part through at least one of said side faces, and provided with a grip portion enabling an operator to manually rotate the driver portion, and a bearing portion of said tensioning mechanism projected into the mounting slot and including a bearing edge for engaging the projection, said bearing portion being advanced toward the projection by rotation of the driver portion for axial movement of the guide bar relative to the projection and thereby movement of the guide bar relative to the drive sprocket.

2. A chain saw guide bar as defined in claim 1 wherein the driver portion is a pinion having teeth and the bearing portion is a rack having teeth mated to the teeth of the pinion, said pinion rotatably driving the rack along the bar length and into engagement with the projection.

3. A chain saw guide bar as defined in claim 2 wherein the bearing edge of the rack is V or U configured to center the movement of the guide bar relative to the chain saw housing.

4. A chain saw guide bar as defined in claim 1 wherein the driver portion is a cam member having a center around which the cam member is rotated and the bearing portion is the periphery of the cam member which varies in distance from the center, said periphery in contact with the projection and extending the distance between the center and the projection as the cam member is rotated.

5. A chain saw guide bar as defined in claim 4 wherein the cam member is pivotal about an axis of rotation and the periphery increases in radial distance substantially through an entire rotation of the cam member.

6. A chain saw guide bar as defined in claim 1 wherein the driver portion is a cam member and the bearing portion is a slide member slidable along the mounting slot toward the projection, said cam engaging the slide member and upon rotation, camming the slide member against the projection.

7. A chain saw guide bar as defined in claim 6 wherein a hub portion projects from the cam member through the side face and defines an axis of rotation of the cam member.

8. A chain saw guide bar comprising:

an elongated guide bar member defining opposed side faces and upper and lower edges having saw chain guide grooves, and rear and front ends, said rear end including a mounting slot extended axially along a length of the bar for mounting the bar to mounting studs on a chain saw housing;

a cavity provided in the guide bar member between the side faces, said cavity having a first portion extended axially along the length of the guide bar member and overlapping with and forward of the mounting slot, and a second portion configured to receive a pinion and an opening extending from the configured second portion to the exterior of the guide bar member at one of said side faces; and a rack slidably positioned in the first portion of the cavity and a pinion rotatably positioned in the configured second portion of the cavity, said rack and said pinion provided with gear teeth in mating engagement whereby turning movement of the pinion produces sliding movement of the rack, and said pinion provided with a gripping feature accessible through the opening to enable turning of the pinion from the exterior of the guide bar member whereby, with the bar mounted on the chain saw housing, upon rearward sliding of the rack, a rearward end of the rack engages a bearing member provided on the chain saw housing to force forward sliding of the bar relative to the bearing member.

9. A chain saw guide bar as defined in claim 8 wherein the guide bar is mounted on the mounting studs of the chain saw housing, one of said studs providing the bearing member, said rack extended along the bar axis and the rear end of the rack being concave to induce centering of the rack and the guide bar relative to the studs for centering of the bar axis along a centering line defined by the studs.

10. A chain saw guide bar as defined in claim 8 wherein the pinion is loose fitting in the cavity and forced sliding of the rack against the bearing member creates binding of the pinion in the cavity and resistance to reverse turning of the pinion.

11. A chain saw guide bar as defined in claim 10 wherein the cavity is configured to provide a protruding edge for engagement by the gear teeth of the pinion.

12. A chain saw guide bar as defined in claim 8 wherein the gripping feature is a slot for receiving a blade of a tool which enables a user to turn the pinion.

13. A chain saw guide bar as defined in claim 8 wherein the bar consists of a center laminate and two side laminates, said first portion of the cavity provided in the center laminate and extended rearwardly at least the length of the mounting slot, the mounting slot provided in the guide bar having a width that is more narrow than the first portion of the cavity and the rack whereby the rack is retained within the first portion of the cavity as it is extended rearwardly along the mounting slot.

14. A chain saw guide bar as defined in claim 8 wherein upsets are provided in the travel path of the gear teeth of one of said pinion and said rack.

15. A chain saw guide bar as defined in claim 8 wherein a biasing member provided behind the pinion biases the pinion toward a forward position.

16. A chain saw guide bar as defined in claim 15 wherein a slot is provided in the guide bar rearward of the configured portion to form a depending finger that is resilient and provides said biasing member.

* * * * *